US005672215A

United States Patent [19]

Azuma et al.

[11] Patent Number: 5,672,215

[45] Date of Patent: Sep. 30, 1997

[54] DUPLEX STAINLESS STEEL EXCELLENT IN CORROSION RESISTANCE

[75] Inventors: Shigeki Azuma, Kobe; Kazuhiro Ogawa, Nishinomiya, both of Japan

[73] Assignee: Sumitomo Metal Industries, Ltd., Osaka, Japan

[21] Appl. No.: 682,596

[22] PCT Filed: Dec. 14, 1995

[86] PCT No.: PCT/JP95/02524

§ 371 Date: Jul. 24, 1996

§ 102(e) Date: Jul. 24, 1996

[87] PCT Pub. No.: WO96/18751

PCT Pub. Date: Jun. 20, 1996

[30] Foreign Application Priority Data

Dec. 16, 1994 [JP] Japan ..... 6-312284

[51] Int. Cl.[6] ..... C22C 38/42

[52] U.S. Cl. ..... 148/325; 148/326; 420/60; 420/61

[58] Field of Search ..... 148/325, 326; 420/60, 61

[56] References Cited

U.S. PATENT DOCUMENTS 4,798,635 1/1989 Bernhardsson et al. .

FOREIGN PATENT DOCUMENTS

0156778 B1 1/1989 European Pat. Off. .
0337846 A1 10/1989 European Pat. Off. .
49-135812 12/1974 Japan .
52-716 1/1977 Japan .
56-142855 11/1981 Japan .
58-224155 12/1983 Japan .
61-56267 3/1986 Japan .
2-258956 10/1990 Japan .
3-82739 4/1991 Japan .
3-229839 10/1991 Japan .

OTHER PUBLICATIONS

European Search Report dated Mar. 19,1996.

*Primary Examiner*—Deborah Yee
*Attorney, Agent, or Firm*—Burns, Doane, Swecker & Mathis, LLP

[57] ABSTRACT

An inexpensive, highly corrosion-resistant duplex stainless steel suitable for use in constructing piping systems, heat exchangers and the like to be installed in plants of oil refining industries, chemical industries and such. The highly corrosion-resistant duplex stainless steel has a chemical composition, in weight percent: 0.05 to 2.0% Si, 0.1 to 4.0% Mn, 1.0 to 4.0% Ni, 20.0 to 26.0% Cr, over 1.0 to 3.0% Cu, 0.002 to 0.05% Al, 0.10 to 0.40% N, 0.05 to 0.50% the sum of at least one of V, Ti and Nb, when necessary, 0.50% or less Mo, 0.50% or less W and 0.0030 or less B, 0.0030% or less Ca, and the balance of Fe and unavoidable impurities. Impurity contents are 0.05% or less C, 0.03% or less P and 0.005% or less S. The duplex stainless steel has $Ni_{bal}$ value expressed by the following Equation (1) in the range of −11.0 to −8.0:

$$Ni_{bal}=Ni_{eq}-1.1\times Cr_{eq}+8.2 \quad (1)$$

where $$Ni_{eq}=Ni(\%)+0.5\times Cu(\%)+30\times\{C(\%)+N(\%)\} \quad (2)$$

$$Cr_{eq}=Cr(\%)+1.5\times Si(\%)+Mo(\%)+W(\%) \quad (3).$$

19 Claims, 5 Drawing Sheets

FIG. 1

| Steel No. | Chemical composition (percent by weight) Balance:Fe and unavoidable impurities | | | | | | | | | | | | | | | | | | ※1 |
|---|---|---|---|---|---|---|---|---|---|---|---|---|---|---|---|---|---|---|---|
| | C | Si | Mn | P | S | Ni | Cu | Cr | N | Al | V | Nb | Ti | Mo | W | Ca | B | O | $Ni_{bal}$ |
| 1 | 0.022 | 0.46 | 1.1 | 0.023 | 0.002 | 3.6 | 1.6 | 25.6 | 0.21 | 0.011 | 0.34 | - | - | - | - | - | - | 0.002 | - 9.4 |
| 2 | 0.019 | 0.53 | 1.4 | 0.021 | 0.001 | 2.8 | 1.2 | 24.5 | 0.19 | 0.013 | - | 0.15 | - | - | - | - | - | 0.002 | -10.0 |
| 3 | 0.036 | 0.36 | 1.9 | 0.016 | 0.001 | 3.4 | 1.4 | 25.1 | 0.18 | 0.008 | - | - | 0.11 | - | - | - | - | 0.003 | - 9.4 |
| 4 | 0.022 | 0.68 | 2.1 | 0.016 | 0.001 | 2.4 | 1.7 | 23.6 | 0.21 | 0.011 | 0.08 | 0.12 | - | - | - | - | - | 0.004 | - 8.7 |
| 5 | 0.011 | 0.36 | 1.8 | 0.028 | 0.004 | 2.9 | 2.1 | 24.3 | 0.17 | 0.008 | 0.12 | - | 0.05 | - | - | - | - | 0.002 | - 9.7 |
| 6 | 0.021 | 0.56 | 1.6 | 0.022 | 0.001 | 3.5 | 1.5 | 23.1 | 0.16 | 0.006 | 0.12 | - | - | - | - | 0.0013 | - | 0.006 | - 8.5 |
| 7 | 0.032 | 0.75 | 2.1 | 0.009 | 0.002 | 3.7 | 1.4 | 24.6 | 0.18 | 0.011 | 0.16 | - | - | - | - | - | 0.0009 | 0.002 | - 9.3 |
| 8 | 0.012 | 0.84 | 1.5 | 0.013 | 0.003 | 3.9 | 1.8 | 24.1 | 0.13 | 0.007 | 0.12 | - | - | - | - | 0.0014 | 0.0013 | 0.004 | -10.6 |
| 9 | 0.021 | 0.45 | 0.9 | 0.025 | 0.003 | 3.5 | 1.3 | 25.3 | 0.22 | 0.009 | - | 0.10 | 0.06 | - | - | - | - | 0.004 | - 9.0 |
| 10 | 0.023 | 0.96 | 1.2 | 0.012 | 0.001 | 3.9 | 1.8 | 25.2 | 0.18 | 0.012 | 0.12 | - | - | 0.26 | - | - | - | 0.002 | -10.5 |
| 11 | 0.023 | 0.86 | 1.5 | 0.009 | 0.002 | 3.7 | 1.6 | 24.3 | 0.21 | 0.011 | - | 0.26 | - | - | 0.48 | 0.0010 | - | 0.004 | - 9.0 |
| 12 | 0.024 | 0.46 | 2.3 | 0.019 | 0.001 | 2.6 | 1.8 | 23.8 | 0.21 | 0.013 | 0.12 | - | - | 0.23 | 0.22 | - | 0.0016 | 0.003 | - 8.7 |
| 13 | 0.019 | 0.59 | 1.8 | 0.023 | 0.001 | 3.9 | 1.8 | 24.5 | 0.16 | 0.009 | - | - | 0.11 | - | 0.42 | 0.0021 | 0.0008 | 0.004 | -10.0 |

Note : ※1 $Ni_{bal}=Ni_{eq}-1.1\times Cr_{eq}+8.2$ where $Ni_{eq}=Ni\ (\%)+0.5\times Cu\ (\%)+30\times (C\ (\%)+N\ (\%))$ $Cr_{eq}=Cr\ (\%)+1.5\times Si\ (\%)+Mo\ (\%)+W\ (\%)$

FIG. 2

| Steel No. | Chemical composition (percent by weight) Balance: Fe and unavoidable impurities | | | | | | | | | | | | | | | | | | ※1 | Remarks |
|---|---|---|---|---|---|---|---|---|---|---|---|---|---|---|---|---|---|---|---|---|
| | C | Si | Mn | P | S | Ni | Cu | Cr | N | Al | V | Nb | Ti | Mo | W | Ca | B | O | $Ni_{eq1}$ | |
| 14 | 0.021 | 0.46 | 1.1 | 0.015 | 0.001 | 3.9 | 0.6 | 23.2 | 0.12 | 0.011 | - | - | - | 0.24 | - | - | - | 0.006 | - 9.9 | UNS-S32304 |
| 15 | 0.036 | 0.26 | 1.5 | 0.022 | 0.002 | 3.9 | 1.6 | 23.4 | 0.08 | 0.008 | 0.13 | - | - | - | - | - | - | 0.003 | - 9.8 | |
| 16 | 0.023 | 0.36 | 3.1 | 0.022 | 0.001 | 0.8 | 2.8 | 24.2 | 0.19 | 0.016 | 0.25 | - | - | - | - | - | - | 0.002 | -10.4 | |
| 17 | 0.016 | 0.59 | 1.4 | 0.021 | 0.002 | 3.9 | 1.7 | 24.3 | 0.16 | 0.008 | - | - | - | 0.34 | - | - | - | 0.004 | - 9.5 | |
| 18 | 0.008 | 0.50 | 1.2 | 0.016 | 0.002 | 3.8 | 1.3 | 23.5 | 0.13 | 0.007 | 0.02 | - | - | - | - | - | - | 0.003 | - 9.9 | |
| 19 | 0.006 | 0.36 | 1.4 | 0.022 | 0.004 | 3.4 | 1.6 | 24.2 | 0.18 | 0.013 | - | 0.04 | - | - | - | - | - | 0.005 | - 9.2 | |
| 20 | 0.011 | 0.46 | 1.1 | 0.008 | 0.002 | 3.9 | 1.1 | 23.9 | 0.14 | 0.009 | - | - | 0.03 | - | - | - | - | 0.004 | - 9.9 | |
| 21 | 0.022 | 0.46 | 1.2 | 0.023 | 0.002 | 13.6 | 0.12 | 16.9 | 0.04 | 0.008 | - | - | - | 2.36 | - | - | - | 0.003 | 1.8 | SUS316L |
| 22 | 0.008 | 0.21 | 0.1 | 0.021 | 0.001 | 0.02 | 0.01 | 19.2 | 0.01 | 0.056 | - | - | - | 2.36 | - | - | - | 0.003 | -15.3 | SUS444 |
| 23 | 0.021 | 0.56 | 1.6 | 0.026 | 0.001 | 5.9 | 0.02 | 22.1 | 0.16 | 0.013 | - | - | - | 3.15 | - | - | - | 0.003 | - 9.2 | SUS329J3L |
| 24 | 0.021 | 1.68 | 1.5 | 0.023 | 0.002 | 4.9 | 0.02 | 18.5 | 0.06 | 0.009 | - | - | - | 2.75 | - | - | - | 0.004 | -10.6 | UNS-S31500 |

Note : Underlined values are those outside ranges specified by the present invention.

※1 $Ni_{eq1} = Ni_{eq} - 1.1 \times Cr_{eq} + 8.2$ where $Ni_{eq} = Ni\ (\%) + 0.5 \times Cu\ (\%) + 30 \times \{C\ (\%) + N\ (\%)\}$ $Cr_{eq} = Cr\ (\%) + 1.5 \times Si\ (\%) + Mo\ (\%) + W\ (\%)$

FIG. 3

| Corrosion test condition | Condition I | Condition II |
|---|---|---|
| Temperature (℃) | 120 | 120 |
| Concentration of chlorides (ppm) | 500 | 500 |
| Concentration of chloric acid (ppm) | 30 | 30 |
| Partial pressure of hydrogen sulphide (atm) | 0 (air) | 0.01 |
| Duration of immersion (hr) | 500 | 500 |

FIG. 4

| Steel No. | 0.2%Proof stress (MPa) | Corrosion test condition I | | Corrosion test condition II | | Remarks |
|---|---|---|---|---|---|---|
| | | Corrosion rate ※1 | Localized corrosion ※2 | Corrosion rate ※1 | Localized corrosion ※2 | |
| 1 | 612 | A | A | A | A | Invention steel |
| 2 | 586 | A | A | A | A | |
| 3 | 563 | A | A | A | A | |
| 4 | 612 | A | A | A | A | |
| 5 | 604 | A | A | A | A | |
| 6 | 572 | A | A | A | A | |
| 7 | 588 | A | A | A | A | |
| 8 | 593 | A | A | A | A | |
| 9 | 582 | A | A | A | A | |
| 10 | 610 | A | A | A | A | |
| 11 | 590 | A | A | A | A | |
| 12 | 599 | A | A | A | A | |
| 13 | 611 | A | A | A | A | |
| 14 | 512 | A | A | B | B | Comparative steel |
| 15 | 580 | B | B | B | B | |
| 16 | 603 | B | B | B | C | |
| 17 | 526 | A | B | A | B | |
| 18 | 521 | A | A | A | A | |
| 19 | 514 | A | A | A | A | |
| 20 | 523 | A | A | A | A | |
| 21 | 272 | A | C | B | C | |
| 22 | 385 | A | A | C | B | |
| 23 | 581 | A | A | A | A | |
| 24 | 612 | B | B | B | B | |

Note :

※1 Evaluation of corrosion rate

| Mark | Corrosion rate ($g \cdot m^{-2} \cdot h^{-1}$) |
|---|---|
| A | <0.01 |
| B | 0.01−0.1 |
| C | >0.1 |

※2 Evaluation of localized corrosion

| Mark | Type of localized corrosion |
|---|---|
| A | No localized corrosion |
| B | pitting corrosion |
| C | corrosion cracking |

DUPLEX STAINLESS STEEL EXCELLENT IN CORROSION RESISTANCE

TECHNICAL FIELD

The present invention relates to an inexpensive, highly corrosion-resistant duplex stainless steel suitable for use in constructing piping systems, heat exchangers and the like, to be installed in plants of oil refining industries, chemical industries and such.

BACKGROUND ART

Generally, carbon steels are used most prevalently as materials for constructing piping systems for handling fluids, such as industrial water and halfway products, and heat exchangers to be installed in plants of oil refining industries and chemical industries. Since the corrosion resistance of carbon steels with industrial water is not necessarily satisfactory, those facilities need to be renewed everythree to ten years depending on the degree of progress of corrosion. Recently, extension of the period of routine inspection of plants and extension of the life of equipment have been desired to reduce progressively increasing maintenance costs and facility renewal costs. Consequently, it is the trend of the times to use corrosion-resistant materials including stainless steels for constructing equipment that has been constructed from carbon steels.

Austenitic stainless steels of JIS (Japanese Industrial Standards) designations SUS304, SUS316, SUS304L and SUS316L are most commonly used because of their excellent corrosion resistance and weldability. Although highly resistant to pitting and crevice corrosion, austenitic stainless steels are susceptible to stress corrosion cracking (SCC). Although plants of oil refining industries and chemical industries use industrial water on a massive scale for cooling and the like, there is the possibility that chlorides contained in a very small concentration of 300 ppm or less in industrial water cause SCC.

Although very excellent in SCC resistance, ferritic stainless steels are inferior to austenitic stainless steels in weldability and toughness, hence it is not quite satisfactory to substitute austenitic stainless steels with ferritic stainless steels. Duplex stainless steels which have been developed to solve such a problem have a duplex structure consisting of ferrite and austenite, are excellent in SCC resistance, weldability and toughness as compared with austenitic stainless steel, and have a higher strength than those of ferritic stainless steels and austenitic stainless steels.

Standard duplex stainless steels specified in JIS and ASTM Standards are 18% Cr-3% Mo system stainless steel of ASTM-UNS-S31500, 23% Cr-0.4% Mo system stainless steel of ASTM-UNS-S32304, 22% Cr-3% Mo system stainless steel of SUS329J3L (UNS-S31803), and 25% Cr-3% Mo system stainless steel of SUS329J4L (UNS-S31260, S32550). These steels, having a greater Cr and Mo content, have higher corrosion resistance. The stainless steel UNS-S32304 having a relatively small Cr and Mo content is a relatively inexpensive duplex stainless steel and its corrosion resistance is substantially the same as those of austenitic stainless steels SUS316 and SUS316L.

The field of application of duplex stainless steels has been expanding owing to the foregoing characteristics. Disclosed in JP-A No. 52-716 is a duplex stainless steel of UNS-S31260 system containing over 20% but not more than 35% Cr, 3 to 12% Ni, 0.5 to 5.0% Mo, 0.2 to 1.5% Cu, W and V, and excellent in resistance to intergranular corrosion by sea water. Disclosed in JP-A No. 56-142855 is a duplex stainless steel containing 20 to 35% Cr, 3 to 10% Ni, 0.5 to 6.0% Mo, W or V, and B, and excellent in hot workability and resistance to localized corrosion. Disclosed in JP-A No. 61-56267 is a duplex stainless steel containing 21 to 24.5% Cr, 2 to 5.5% Ni, 0.01 to 1.0% Mo and 0.01 to 1.0% Cu, and excellent in weldability and corrosion resistance. Disclosed in EP 0 337 846 B1 (Oct. 18, 1989) is an invention relating to a steel having enhanced wear corrosion resistance to the corrosive action of sulfuric acid and obtained by adding 1 to 3.5% Cu to a 23%Cr–0.4%Mo steel analogous to that of UNS-S32304.

Duplex stainless steels are inferior in hot workability, and surface flaws are liable to be formed on workpieces of duplex stainless steels during billet rolling or hot tube rolling, which is due to their mixed structures of ferrite and austenite which are different from each other in deformation behavior. An invention disclosed in JP-A No. 3-82739 to improve the hot workability of duplex stainless steels controls the S and the O content, and adds very small quantities of Ca, Mg, REM and the like to duplex stainless steels. Thus various improvements have been put into duplex stainless steels to utilize effectively the excellent corrosion resistance and SCC resistance of duplex stainless steels.

Oil refineries and chemical industries handle hydrocarbon gases in halfway products as fluids other than industrial water on a massive scale. These gases are not fully dehydrated and contain moisture and, in most cases, chlorides and hydrogen chloride, or hydrogen sulfide. Therefore, condensed water that forms when the temperature of the plant drops contains chlorides and hydrogen chloride, or hydrogen sulfide. Accordingly, the equipment of the plant must be formed from materials excellent in resistance to corrosion by solutions containing chlorides and hydrogen chloride, or hydrogen sulfide, i.e., resistance to pitting and crevice corrosion. There has been a demand for economically effective duplex stainless steels having, in addition to corrosion resistance, a sufficiently high strength necessary to achieve satisfactory durability under such an environment and capable of being easily manufactured.

DISCLOSURE OF THE INVENTION

Accordingly, it is an object of the present invention to provide an inexpensive duplex stainless steel intended for use for forming pipes and heat exchangers robe installed in plants of oil refining and chemical industries, excellent in resistance to the corrosive actions of environments containing hydrogen chloride and hydrogen sulfide, as well as, to those of environments containing chlorides, having a high strength and satisfactory hot workability and capable of being easily manufactured.

The inventors of the present invention made detailed studies of the effect of chemical composition and microstructure of duplex stainless steels on the corrosion resistance of the duplex stainless steels in an environment containing chlorides and an environment containing hydrogen chloride and hydrogen sulfide. A duplex stainless steel of UNS-S32304 is the most inexpensive duplex stainless steel that may be able to substitute carbon steels. Although this steel has features of duplex stainless steels including SCC resistance, weldability and toughness, the duplex stainless steels is not satisfactory in corrosion resistance to the corrosive action of a corrosive environment in which duplex stainless steel of the present invention is intended to be used, and the strength of the duplex stainless steel is lower than those of other duplex stainless steels. Therefore, the extension of life of equipment by the use of this steel cannot be expected. This steel has a relatively low strength because the content of Mo, i.e., a strength enhancing element, of the same is small.

It was inferred from the results of examinations of the effects of various additive elements on the improvement of corrosion resistance and strength that the addition of V, Nb and Ti, in addition to Cu and N, is important.

It is known that the addition of Cu is effective in improving acid resistance and crevice corosion resistance. Austenitic stainless steels, such as SUS316J1, are allowed to contain 2.5% Cu at the maximum. However, duplex stainless steels intended to be used in neutral environments, such as duplex stainless steels of UNS-S32304 and SUS329J4L, are allowed to contain less than 1.0% Cu because Cu may possibly deteriorate corrosion resistance.

Nevertheless, the inventors of the present invention found that a large Cu content remarkably improves the corrosion resistance of duplex stainless steels in aqueous solutions containing hydrogen chloride and hydrogen sulfide in acidic environments; that is, it was found that Cu is very effective in securing corrosion resistance in corrosive environments in which duplex stainless steels of the present invention are intended to be used. Concretely, when Cu was added to a duplex stainless steel in a Cu content over 1.0%, the duplex stainless steel had excellent corrosion resistance and other properties of the duplex stainless steel were not deteriorated.

It was also found that the corrosion resistance of a duplex stainless steel could be enhanced to a level equal to that of a known duplex stainless steel of a high Ni content and a high Mo content by the addition of Cr and N in a high Cr content and a high N content, in addition of Cu, to the duplex stainless steel. N is a potent austenite producing element and can be used instead of Ni used for austenite producing effect for controlling the microstructure of duplex stainless steels. A large N content was effective also in improving the pitting corrosion resistance of a duplex stainless steel. As is generally known, the addition of Mo is effective in suppressing pitting corrosion. The same pitting corrosion resistance enhancing effect as that provided by a duplex stainless steel containing Mo can be provided by a duplex stainless steel of a large N content not containing Mo or containing Mo in a small Mo content.

V, Nb and Ti are used as additives for fixing C and N to suppress the deterioration of the corrosion resistance and toughness of ferritic stainless steels or austenitic stainless steels due to sensitization. It was found that the addition of those elements to duplex stainless steels enhances the strength of those duplex stainless steels significantly. Such a strength enhancement is inferred to be due to precipitation hardening resulting from the precipitation of minute grains of carbides and nitrides. It was also found through studies to improve hot workability that the addition of B or Ca is effective. Therefore, B or Ca is added to duplex stainless steels if necessary.

The present invention has been made through the further examination based on the foregoing knowledge. The gist of the present invention will be summarized below, in which the unit of content of elements indicated by "%" signifies "percent by weight".

(1) A highly corrosion-resistant duplex stainless steel having a chemical composition: 0.05 to 2.0% Si, 0.1 to 4.0% Mn, 1.0 to 4.0% Ni, 20.0 to 26.0% 15 Cr, over 1.0 to 3.0% Cu, 0.002 to 0.05% Al, 0.10 to 0.40% N, 0.05 to 0.50% the sum of at least one of V, Ti and Nb, and the balance of Fe and unavoidable impurities, impurity contents being 0.05% or less C, 0.03% or less P and 0.005% or less S; wherein the duplex stainless steel has $Ni_{bal}$ value expressed by the following Equation (1) in the range of −11.0 to −8.0:

$$Ni_{bal}=Ni_{eq}-1.1\times Cr_{eq}+8.2 \quad (1)$$

where $$Ni_{eq}=Ni(\%)+0.5\times Cu(\%)+30\times\{C(\%)+N(\%)\} \quad (2)$$

$$Cr_{eq}=Cr(\%)+1.5\times Si(\%)+Mo(\%)+W(\%) \quad (3)$$

(2) A highly corrosion-resistant duplex stainless steel having a chemical composition: 0.05 to 2.0% Si, 0.1 to 4.0% Mn, 1.0 to 4.0% Ni, 20.0 to 26.0% Cr, over 1.0 to 3.0% Cu, 0.002 to 0.05% Al, 0.10 to 0.40% N, 0.05 to 0.50% the sum of at least one of V, Ti and Nb, 0.50% or less Mo, 0.50% or less W, and the balance of Fe and unavoidable impurities, impurity contents being 0.05% or less C, 0.03% or less P and 0.005% or less S; wherein the duplex stainless steel has $Ni_{bal}$ value expressed by Equation (1) in the range of −11.0 to −8.0.

(3) A highly corrosion-resistant duplex stainless steel having a chemical composition: 0.05 to 2.0% Si, 0.1 to 4.0% Mn, 1.0 to 4.0% Ni, 20.0 to 26.0% Cr, over 1.0 to 3.0% Cu, 0.002 to 0.05% Al, 0.10 to 0.40% N, 0.05 to 0.50% the sum of at least one of V, Ti and Nb, 0.0030% or less B, 0.0030% or less Ca, and the balance of Fe and unavoidable impurities, impurity contents being 0.05% or less C, 0.03% or less P and 0.005% or less S; wherein the duplex stainless steel has $Ni_{bal}$ value expressed by Equation (1) in the range of −11.0 to −8.0.

(4) A highly corrosion-resistant duplex stainless steel having a chemical composition: 0.05 to 2.0% Si, 0.1 to 4.0% Mn, 1.0 to 4.0% Ni, 20.0 to 26.0% Cr, over 1.0 to 3.0% Cu, 0.002 to 0.05% Al, 0.10 to 0.40% N, 0.05 to 0.50% the sum of at least one of V, Ti and Nb, 0.50% or less Mo, 0.50% or less W, 0.0030 or less B, 0.0030% or less Ca, and the balance of Fe and unavoidable impurities, impurity contents being 0.05% or less C, 0.03% or less P and 0.005% or less S; wherein the duplex stainless steel has $Ni_{bal}$ value expressed by Equation (1) in the range of −11.0 to −8.0.

BRIEF DESCRIPTION OF THE DRAWINGS

FIG. 1 is a table of the chemical compositions of steels in preferred embodiments of the present invention;

FIG. 2 is a table of the chemical compositions of steels in comparative examples;

FIG. 3 is a table of conditions for the corrosion tests of steels;

FIG. 4 is a table showing the yield strength of steels tested by tensile tests, and results of corrosion tests.

BEST MODE FOR CARRYING OUT THE INVENTION

Figure 5:
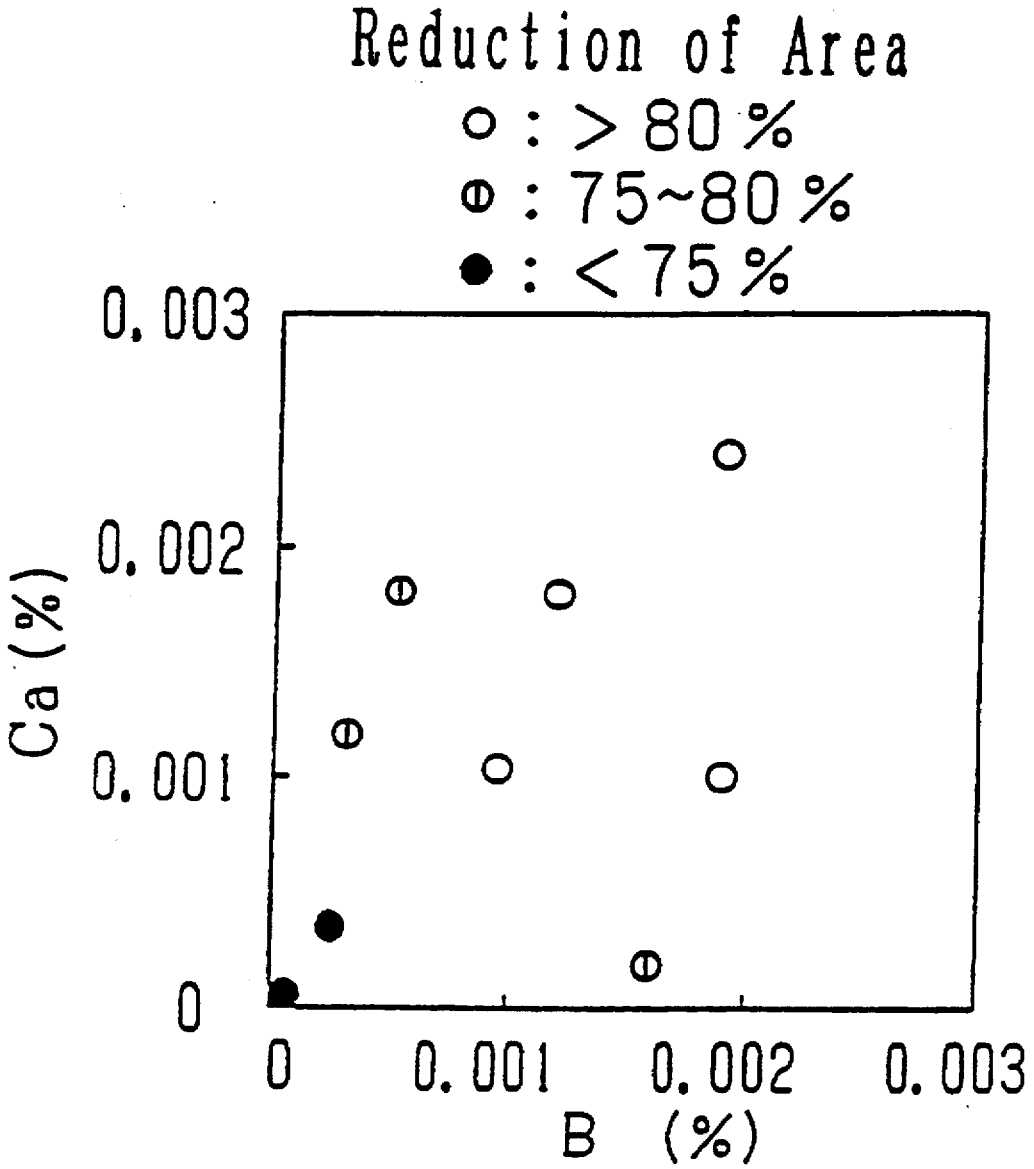
FIG. 5 is a graph showing the dependence of reduction of area determined by tensile tests at 950° C. on B content and Ca content.

Reasons for limiting chemical compositions according to the present invention will be described in detail hereinafter. In the following description, unit of content indicated by "%" signifies "percent by weight" throughout.

Si: 0.05 to 2.0%

Si is effective in enhancing pitting corrosion resistance and SCC resistance. The Si content is 0.05% or above. Si contained in a Si content exceeding 2.0% deteriorates hot workability and, similarly to Cr, accelerates the precipitation of intermetallic compounds and reduces toughness. Therefore, the Si content shall be 0.05% to 2.0%.

Mn: 0.1 to 4.0%

Mn stabilizes austenite and, similarly to Cr, increases the solubility of N. The Mn content is 0.1% or above. However, as seen from the viewpoint of corrosion resistance, a large Mn content is undesirable because Mn produces manganese sulfide from which pitting corrosion starts. The adverse effect of Mn on corrosion resistance becomes significant particularly when the Mn content exceeds 4.0%. Therefore, the Mn content shall be 0.1 to 4.0%.

Ni: 1.0 to 4.0%

Ni is effective in stabilizing austenite and enhancing corrosion resistance. However, the effect of Ni is unsatisfactory when the Ni content is less than 1.0%. The addition of Ni in a large Ni content increases the material cost because Ni is an expensive alloying element as well as Mo. Since the austenite producing effect can sufficiently be supplemented with N, the upper limit of Ni content is 4.0%. Therefore, the Ni content is 1.0 to 4.0%. As seen from the viewpoint of providing an inexpensive material, which is one of the objects of the present invention, it is desirable that the upper limit of the Ni content is less than 3.0%.

Cr: 20.0 to 26.0%

Cr is a basic element necessary for maintaining corrosion resistance and for producing ferrite. Since Cr is effective in increasing the solubility of N in steels, the present invention, which utilizes N effectively, needs a Cr content of not less than 20.0%. A Cr content exceeding 26.0% accelerates the precipitation of intermetallic compounds such as a sigma phase, deteriorates hot workability, toughness of weld zones and corrosion resistance. Therefore, the Cr content shall be 20.0 to 26.0%.

Cu: Over 1.0 to 3.0%

Cu, as well as N, is an important alloying element in the present invention. Cu enhances corrosion resistance greatly. The Cu content must be over 1.0% to exert effective corrosion resistance in an environment containing hydrogen chloride and hydrogen sulfide in addition to chlorides. The effect of Cu saturates in a range of Cu content exceeding 3.0%. Therefore, Cu content shall be over 1.0 to 3.0%. For a further stable effect, it is desirable that the Cu content is greater than 1.5%.

Al: 0.002 to 0.05%

Al is added as a deoxidizing element to obtain a sound cast billet. Al content must be 0.002% or above. However, Al is liable to combine with N to produce nitrides which deteriorate corrosion resistance when the N content is large, and hence the Al content must be limited. The Al content is 0.05% or less. Therefore, the Al content is 0.002 to 0.05%.

N: 0.10 to 0.40%

N is one of alloying elements which feature the present invention. N stabilizes austenite and is an important element for controlling the microstructure of the duplex stainless steel. N is effective also in improving pitting corrosion resistance. The N content must be 0.10% or above to attain those effects. A N content exceeding 0.40% deteriorates corrosion resistance because N is unable to dissolve completely into matrix and chromium nitride precipitates. Therefore the N content shall be 0.10 to 0.40%.

V, Nb and Ti: 0.05 to 0.5% in total

V, Nb and Ti are effective in enhancing strength. The duplex stainless steel contains at least one of V, Nb and Ti. Although one, two or all of V, Nb and Ti may be added, the total content of these elements must be 0.05% or above to achieve strength enhancement by the addition of these elements. Intermetallic compounds are produced and the corrosion resistance and toughness of weld zones are deteriorated when the total content exceeds 0.5%. Therefore, the total content shall be 0.05 to 0.5%.

Mo: 0.5% or less, W: 0.50% or less

Although Mo and W are not necessarily essential, Mo and W improve corrosion resistance and may be added when necessary. Since Mo and W are expensive elements, the present invention adds Cr and N in a relatively large content. However, the present invention do not avoid adding Mo and W; Mo and W may be added when necessary. Although desirable content of either element is over 0.05%, the effect of the element saturates in the range exceeding 0.5%. Therefore, the upper limit of content of either element shall be 0.50%.

B: 0.0030% or less

Although B is not necessarily essential, B improves hot workability. It is inferred that B segregates into and strengthens grain boundaries to improve workability. Since an excessive B content deteriorates the pitting corrosion resistance of weld zones, the B content shall be 0.0030% or less. The effect of B is insignificant when the B content is less than 0.0005%, a desirable B content is in the range of 0.0005 to 0.0030%.

Ca: 0.0030% or less

Although not an essential element, Ca improves hot workability and is added when necessary. It is inferred that Ca improves hot workability by combining with S that segregates into and reduces the strength of grain boundaries and induces cracking, and forming stable, harmless calcium sulfide. Since pitting corrosion resistance is deteriorated if the Ca content is excessively large, the upper limit of the Ca content is 0.0030%. The effect of Ca is insignificant if the Ca content is excessively small. Therefore a desirable Ca content is in the range of 0.0005 to 0.0030%.

The following elements are impurities.

C: 0.05% or less

Chromium carbide precipitates when the C content exceeds 0.05% and toughness and corrosion resistance are deteriorated. Therefore the C content shall be 0.05% or less.

P: 0.03% or less

Cracking is liable to occur during welding and the corrosion resistance of weld zones is deteriorated when the P content is excessively large. Therefore, the P content shall be 0.03% or less.

S: 0.005% or less

S tends to produce manganese sulfide from which pitting corrosion starts as mentioned in connection with the description of Mn content, and affects hot workability adversely. Therefore, the S content must be reduced to the least possible extent. When the S content is 0.005% or less, Mn of part of Mn S is replaced with Cr and part of MnS is converted into CrS, whereby the deterioration of corrosion resistance is suppressed. Therefore, the S content shall be 0.005% or less, desirably, 0.001% or less.

O (Oxygen): 0.01% or less

Since oxygen produces oxide inclusions in a steel and pitting corrosion starts from such oxide inclusions, O content must be reduced to the least possible extent. The deterioration of corrosion resistance becomes significant when the O content increases. Therefore, the O content shall be 0.1% or less.

$Ni_{bal}$ value: −11.0 to −8.0

$Ni_{bal}$ value calculated on the basis of the contents of the alloying elements of a steel in accordance with the present invention is an index for estimating the ratio between the austenite phase and the ferrite phase in a duplex stainless steel. When $Ni_{bal}$ value is less than −11.0, the content of ferrite forming elements is excessively large and corrosion resistance and toughness are deteriorated. When $Ni_{bal}$ value is greater than −8.0, the austenite content is excessively large and corrosion resistance, particularly, SCC resistance, is deteriorated. Therefore, in the duplex stainless steel of the present invention, the area ratio between the austenite phase and the ferrite phase is in the range of 35 to 65% to secure both the corrosion resistance and the toughness of ferritic stainless steel and austenitic stainless steels. Therefore, $Ni_{bal}$ value shall be in the range of −11.0 to −8.0, desirably, −11.0 to −9.0.

First Embodiment

Ingots of steels having chemical compositions shown in FIGS. 1 and 2 were produced by melting the component elements in a vacuum induction furnace, the ingots were processed by hot forging and hot rolling to produce 5 mm thick steel sheets. The steel sheets were heated at 1050° C. for 15 min and then water-cooled for solution treatment. Tensile test specimens each having a parallel section of 4 mm in diameter and 30 mm in length were prepared by machining the steel sheets, and the tensile test specimens were subjected to tensile test. Test specimens of 10 mm in width, 75 mm in length and 2 mm in thickness were prepared by machining the steel sheets, the surfaces of the test specimens were polished with a 600-mesh wet emery papers, the polished surfaces were cleaned with acetone, the test specimens were bent in a U-shape, the test specimens were subjected to corrosion tests with legs of the U-shaped test specimens bound with bolts and nuts of titanium.

Corrosion tests were carried out in two test conditions, i.e., Condition I and Condition II. As shown in FIG. 3, the test specimens were immersed in an aqueous solution containing chlorides and hydrogen chloride in Condition I, and in an aqueous solution additionally containing hydrogen sulfide in Condition II. The corrosion rate was determined on the basis of a change in weight before and after testing, and the surfaces of the test specimens were inspected visually for pitting corrosion and stress corrosion cracking (SCC).

FIG. 4 shows proof stresses determined by tensile tests, and the results of corrosion tests. Comparative example 21 is an austenitic stainless steel, comparative example 22 is a ferritic stainless steel, and comparative examples 14, 23 and 24 are duplex stainless steels corresponding to UNS-32304, SUS329J3L and UNS-S31500, respectively. As is obvious from the test results, comparative example 21 is inferior in resistance to localized corrosion, i.e., SCC resistance and pitting corrosion resistance, comparative example 22 is corroded at a very high corrosion rate under specific environmental conditions. Although the duplex stainless steel in comparative example 23 is satisfactory in corrosion rate and localized corrosion resistance, the Ni content and the Mo content of the same are relatively large. The duplex stainless steel in comparative example 14 having a relatively small Mo content and the duplex stainless steel in comparative example 24 having a relatively small Cr content are unsatisfactory in resistance to corrosion under certain corrosive conditions.

The corrosion resistances of the steels in examples 1 to 13 having chemical compositions specified by the present invention, not containing or containing only a little Mo and having a small Ni content are equal to or higher than that of the steel in comparative example 23 having a large Mo content and a large Ni content. The strengths of the steels in examples 1 to 13 represented by 0.2% proof strengths are equal to that of the duplex stainless steels in comparative examples 23 and 34 having a large Mo content. The corrosion resistances of the steels in comparative examples 15 and 16 having chemical compositions specified by the present invention and having a N content or a Ni content outside the range specified by the present invention are substantially equal to those of the steel in comparative example 14 having a relatively small Mo content and the steel in comparative example 24 having a relatively small Cr content. As is obvious from the comparative examination of the steel in comparative example 17, and the steels in comparative examples 18 to 20, the steels not containing V, Nb and Ti that form carbides and nitrides are inferior in localized corrosion resistance, and the steels containing those elements are satisfactory in localized corrosion resistance. However, the strength is insufficient when those elements are contained in a small content.

Second Embodiment

Ingots of steels having a chemical composition: 0.02% C, 0.5% Si, 1.5% Mn, 24% Cr, 4% Ni, 1.4% Cu, 0.01% Al, 0.15% N, 0.2% Mo and 0.2% W meeting the present invention, and containing B and Ca in different contents, respectively, were produced by melting the component elements in a vacuum induction furnace. Solid round bars of 10 mm in diameter and 130 mm in length, i.e., test specimens, were prepared by machining the cast ingots. The test specimens were subjected to tensile tests, in which the test specimens were heated at 950° C. and subjected to increasing tensile stress at a straining rate of 1.0/sec until rupture occured. Reduction of area at the point of rupture was measured to compare the hot workability of the steels. Steels having greater reduction of area are superior in hot workability. FIG. 5 is a graph showing the dependence of reduction of area determined by tensile tests at 950° C. on B content and Ca content. In this figure the specimens come under three classifications: reduction of area is over 80%, 75 to 80%, and less than 75%. As is obvious from FIG. 5, a B content or Ca content of 0.0005% or above has the effect of improving hot workability.

POSSIBILITY OF INDUSTRIAL APPLICATION

The resistance of the steels of the present invention against the corrosive action of an aqueous solution containing hydrogen chloride and hydrogen sulfide in addition to chlorides is equal to or higher than that of existing austenitic stainless steels, ferritic stainless steels and duplex stainless steels. The steels of the present invention have sufficiently high strength and satisfactory hot workability, contain little to no Mo and are inexpensive. The steels of the present invention having such characteristics are suitable for use as materials for constructing piping systems and heat exchangers robe installed in plants of oil refining industries and chemical industries.

We claim:

1. A highly corrosion-resistant duplex stainless steel having a chemical composition: 0.05 to 2.0% Si, 0.1 to 4.0% Mn, 1.0 to 4.0% Ni, 20.0 to 26.0% Cr, over 1.0 to 3.0% Cu, 0.002 to 0.05% Al, 0.10 to 0.40% N, 0.05 to 0.50% the sum of at least one of V, Ti and Nb, and the balance of Fe and unavoidable impurities, impurity contents being 0.05% or less C, 0.03% or less P and 0.005% or less S;

wherein the duplex stainless steel has $Ni_{bal}$ value expressed by the following Equation (1) in the range of −11.0 to −8.0:

$$Ni_{bal}=Ni_{eq}-1.1\times Cr_{eq}+8.2 \quad (1)$$

where $$Ni_{eq}=Ni(\%)+0.5\times Cu(\%)+30\times\{C(\%)+N(\%)\} \quad (2)$$

$$Cr_{eq}=Cr(\%)+1.5\times Si(\%)+Mo(\%)+W(\%) \quad (3).$$

2. A highly corrosion-resistant duplex stainless steel having a chemical composition: 0.05 to 2.0% Si, 0.1 to 4.0%

Mn, 1.0 to 4.0% Ni, 20.0 to 26.0% Cr, over 1.0 to 3.0% Cu, 0.002 to 0.05% Al, 0.10 to 0.40% N, 0.05 to 0.50% the sum of at least one of V, Ti and Nb, 0.50% or less Mo, 0.50% or less W, and the balance of Fe and unavoidable impurities, impurity contents being 0.05% or less C, 0.03% or less P and 0.005% or less S;

wherein the duplex stainless steel has $Ni_{bal}$ value expressed by the following Equation (1) in the range of −11.0 to −8.0:

$$Ni_{bal}=Ni_{eq}-1.1\times Cr_{eq}+8.2 \quad (1)$$

where $$Ni_{eq}=Ni(\%)+0.5\times Cu(\%)+30\times\{C(\%)+N(\%)\} \quad (2)$$

$$Cr_{eq}=Cr(\%)+1.5\times Si(\%)+Mo(\%)+W(\%) \quad (3).$$

3. A highly corrosion-resistant duplex stainless steel having a chemical composition: 0.05 to 2.0% Si, 0.1 to 4.0% Mn, 1.0 to 4.0% Ni, 20.0 to 26.0% Cr, over 1.0 to 3.0% Cu, 0.002 to 0.05% Al, 0.10 to 0.40% N, 0.05 to 0.50% the sum of at least one of V, Ti and Nb, 0.0030% or less B, 0.0030% or less Ca, and the balance of Fe and unavoidable impurities, impurity contents being 0.05% or less C, 0.03% or less P and 0.005% or less S;

wherein the duplex stainless steel has $Ni_{bal}$ value expressed by the following Equation (1) in the range of −11.0 to −8.0:

$$Ni_{bal}=Ni_{eq}-1.1\times Cr_{eq}+8.2 \quad (1)$$

where $$Ni_{eq}=Ni(\%)+0.5\times Cu(\%)+30\times\{C(\%)+N(\%)\} \quad (2)$$

$$Cr_{eq}=Cr(\%)+1.5\times Si(\%)+Mo(\%)+W(\%) \quad (3).$$

4. A highly corrosion-resistant duplex stainless steel having a chemical composition: 0.05 to 2.0% Si, 0.1 to 4.0% Mn, 1.0 to 4.0% Ni, 20.0 to 26.0% Cr, over 1.0 to 3.0% Cu, 0.002 to 0.05% Al, 0.10 to 0.40% N, 0.05 to 0.50% the sum of at least one of V, Ti and Nb, 0.50% or less Mo, 0.50% or less W, 0.0030% or less B, 0.0030% or less Ca, and the balance of Fe and unavoidable impurities, impurity contents being 0.05% or less C, 0.03% or less P and 0.005% or less S;

wherein the duplex stainless steel has $Ni_{bal}$ value expressed by the following Equation (1) in the range of −11.0 to −8.0:

$$Ni_{bal}=Ni_{eq}-1.1\times Cr_{eq}+8.2 \quad (1)$$

where $$Ni_{eq}=Ni(\%)+0.5\times Cu(\%)+30\times\{C(\%)+N(\%)\} \quad (2)$$

$$Cr_{eq}=Cr(\%)+1.5\times Si(\%)+Mo(\%)+W(\%) \quad (3).$$

5. The duplex stainless steel of claim 1, containing over 2.0% Mn.

6. The duplex stainless steel of claim 1, containing 0.0005 to 0.003% B.

7. The duplex stainless steel of claim 1, containing 0.0005 to 0.003% Ca.

8. The duplex stainless steel of claim 1, containing 0.0005 to 0.003% B and 0.0005 to 0.003% Ca.

9. The duplex stainless steel of claim 1, containing 0.05 to 0.5 % V.

10. The duplex stainless steel of claim 1, containing 0.05 to 0.5% Ti.

11. The duplex stainless steel of claim 1, containing 0.05 to 0.5% Nb.

12. The duplex stainless steel of claim 1, containing at least 0.05% V and at least 0.05% Nb.

13. The duplex stainless steel of claim 1, containing at least 0.05% V and at least 0.05% Ti.

14. The duplex stainless steel of claim 1, containing at least 0.05 % Nb and at least 0.05% Ti.

15. The duplex stainless steel of claim 1, containing 0.05 to 0.5% Mo.

16. The duplex stainless steel of claim 1, containing 0.05 to 0.5% W.

17. The duplex stainless steel of claim 1, containing 0.05 to 0.5% W and 0.05 to 0.5% Mo.

18. The duplex stainless steel of claim 1, wherein the V, Nb and/or Ti fix C and N in the form of carbide and nitride precipitates.

19. The duplex stainless steel of claim 1, containing less than 3.0% Ni.

* * * * *